US009630747B2

(12) United States Patent
Smith et al.

(10) Patent No.: US 9,630,747 B2
(45) Date of Patent: Apr. 25, 2017

(54) CONTAINER FOR PROVIDING AROMATIC SAMPLING AND VISUALIZATION OF CONTENTS

(71) Applicants: William Thomas Smith, Fair Oaks, CA (US); Cheryl Ann Smith, Fair Oaks, CA (US)

(72) Inventors: William Thomas Smith, Fair Oaks, CA (US); Cheryl Ann Smith, Fair Oaks, CA (US)

( * ) Notice: Subject to any disclaimer, the term of this patent is extended or adjusted under 35 U.S.C. 154(b) by 0 days.

(21) Appl. No.: 14/701,961

(22) Filed: May 1, 2015

(65) Prior Publication Data

US 2016/0318672 A1 Nov. 3, 2016

(51) Int. Cl.

| | |
|---|---|
| ***B65D 25/24*** | (2006.01) |
| ***A47F 7/28*** | (2006.01) |
| ***A45D 34/02*** | (2006.01) |
| ***B65D 85/00*** | (2006.01) |
| ***B65D 43/06*** | (2006.01) |
| ***B65D 47/32*** | (2006.01) |
| ***B65D 39/00*** | (2006.01) |
| ***B65D 25/54*** | (2006.01) |

(52) U.S. Cl.

CPC ..... *B65D 25/54* (2013.01); *A45D 34/02* (2013.01); *A47F 7/286* (2013.01); *B65D 25/24* (2013.01); *B65D 39/0005* (2013.01); *B65D 43/06* (2013.01); *B65D 47/32* (2013.01); *B65D 85/70* (2013.01); *B65D 2201/00* (2013.01)

(58) Field of Classification Search

CPC ..... A45D 34/02; A47F 7/286; B65D 2201/00; B65D 47/32; B65D 25/54; B65D 47/121; B65D 85/52; B65D 85/50; B65D 85/505; B65D 85/70; Y10S 261/88; Y10S 428/905; A01G 5/06

USPC ..... 206/730, 733, 734; 220/367.1, 377, 360, 220/361, 371, 372

See application file for complete search history.

(56) References Cited

U.S. PATENT DOCUMENTS

| | | | | |
|---|---|---|---|---|
| 2,807,901 A | | 10/1957 | Gilowitz | |
| 3,247,995 A | * | 4/1966 | Jensen | B65D 47/121 215/307 |
| 3,656,840 A | | 4/1972 | Smith et al. | |
| 4,230,231 A | * | 10/1980 | Burnett | B65D 39/0047 215/277 |
| 4,284,200 A | * | 8/1981 | Bush | B65D 47/0842 215/215 |

(Continued)

FOREIGN PATENT DOCUMENTS

EP 1779885 5/2007

*Primary Examiner* — Jeffrey Allen
*Assistant Examiner* — Jennifer Castriotta
(74) *Attorney, Agent, or Firm* — Law Offices of David M. Lan; David M. Lang

(57) ABSTRACT

Aspects of the present invention disclose and describe a container for displaying, visualizing, and aroma sampling botanical materials—such as tea, *cannabis*, and the like including a container body, lid, and lens. The container body is shaped to define a mounting projection wherein a sample, such as a botanical sample, may be held. Container body and lid form an airtight seal. A sample may be visualized through the lens. In a preferred embodiment, lid is shaped to define scent openings permitting aroma sampling of a sample contained within. In one embodiment option, one or more projections secure a card bearing sample identification information.

5 Claims, 9 Drawing Sheets

(56) References Cited

U.S. PATENT DOCUMENTS

| | | | | |
|---|---|---|---|---|
| 4,979,332 | A | 12/1990 | Nagaya et al. | |
| 5,321,908 | A | 6/1994 | Ushimaru | |
| 5,363,801 | A | 11/1994 | Watters et al. | |
| 5,927,007 | A | 7/1999 | Oda et al. | |
| 6,013,524 | A | 1/2000 | Friars et al. | |
| 6,571,972 | B1 * | 6/2003 | Bouc | B65D 39/084 137/68.19 |
| 6,761,287 | B2 * | 7/2004 | Caruso | B44D 3/127 215/302 |
| 7,185,827 | B2 | 3/2007 | Quintard et al. | |
| 8,079,478 | B2 | 12/2011 | Short et al. | |
| 8,544,208 | B2 | 10/2013 | Huang | |
| 2003/0234208 | A1 | 12/2003 | Huang | |
| 2007/0051826 | A1 * | 3/2007 | Schofield | A61L 9/03 239/60 |
| 2009/0057326 | A1 * | 3/2009 | Opitz | A45D 33/025 220/789 |
| 2009/0261100 | A1 | 10/2009 | McMinn | |
| 2010/0300370 | A1 | 12/2010 | Hundt | |
| 2013/0313217 | A1 * | 11/2013 | Yamamoto | B65D 1/0207 215/12.1 |
| 2016/0031605 | A1 * | 2/2016 | Bean | B65D 25/54 206/1.5 |

* cited by examiner

CONTAINER FOR PROVIDING AROMATIC SAMPLING AND VISUALIZATION OF CONTENTS

BACKGROUND

Display containers are known in the prior art. Customers commonly wish to visualize contents contained within a display container, and on some occasions, visualize contents under magnification. Further, prospective purchasers frequently wish to test the aroma of contained contents for suitability, freshness, or other features. For example, customers wishing to purchase tea may wish to inspect leaves and sample the aroma. Further, purchasers of legally available *cannabis* commonly wish to inspect the botanical product in detail and sample aroma. Such display containers that permit adequate storage, preservation, and presentation of botanical samples, such as *cannabis*, are not adequately described or available.

SUMMARY

Aspects of the present invention disclose and describe a container for displaying, visualizing, and aroma sampling botanical materials—such as tea, *cannabis*, and the like. Aspects of the present invention further disclose a container permitting stabilization and magnification of a portion of a sample material—such as a botanical sample.

DRAWINGS

DESCRIPTION

Figure 1:
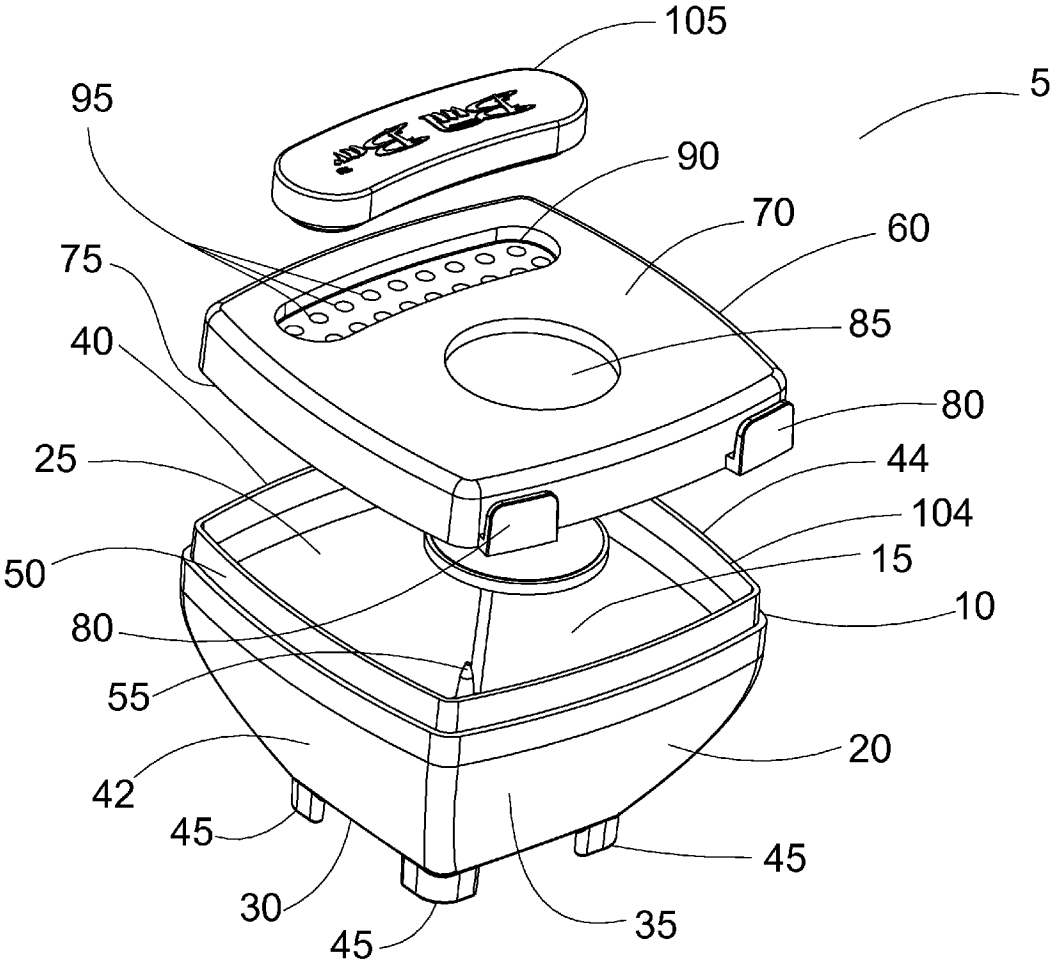
FIG. 1 is an exploded perspective view of an embodiment of the present invention.

Turning now to FIG. 1, container 5 comprises, a container body 10 having an interior surface 15 and exterior surface 20. Container body 10 is shaped to define an open top 25, a bottom 30, a front 35, a back 40, a first side 42, a second side 44, and a plurality of feet 45. Container body 10 is further shaped to define a perimetrical ridge 50 surrounding said open top 25. A portion of the container body 10 is shaped to define mounting projection 55 to hold a subject sample such as a botanical sample.

Lid 60 has an interior lid surface 65 (FIG. 7) and exterior lid surface 70. Lid 60 is shaped to define a perimeter 75, and optionally further shaped to define at least one projection 80 disposed on a portion of said exterior surface 70 of said lid 60. One or more projection 80 functions as a card holder to provide information on the sample within container body. Optionally, projection 80 is omitted and informational material is presented within container body—such as a portion of container body 10 shaped to define a card holder within container body 10. Lid 60 is further shaped to define a viewing opening 85. Lid 60 is further shaped to define a recessed area 90, and further shaped to define a plurality of scent openings 95 within said recessed area 90. In one example embodiment, scent openings are about 0.125 inches in diameter and arranged in two rows. Removable plug 105 shaped to fit within recessed area 90 forming an airtight seal. In one embodiment, the recessed area and removable plug are omitted, and scent holes are located flush on the surface of lid 60, and optionally scent hole patency is adjustable.

Figure 7:
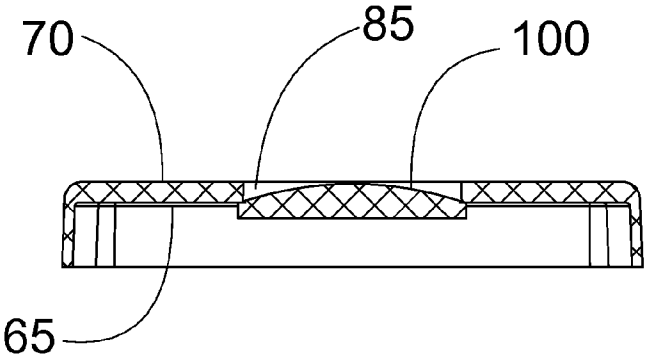
FIG. 7 is a cross-sectional view taken through line 7-7 of FIG. 6.

Turning to FIG. 7, Lens 100 disposed to cover said viewing opening 85. Lens 100 may be affixed to lid 60 by snap fit, or friction fit or adhesively. Lens 100 covers viewing opening 85. Lens 100 forms an airtight seal between lens 100 and said lid 60. In a preferred embodiment, lens 100 is adhesively affixed within viewing opening 85. In one embodiment, lens 100 is a plano-convex lens such as Lens #90-1235 manufactured by J.P. Manufacturing. A variety of lenses may be used such as a 1×, 2×, or 3× magnifier. In an alternative embodiment, the lens is not a magnifier.

Figure 8:
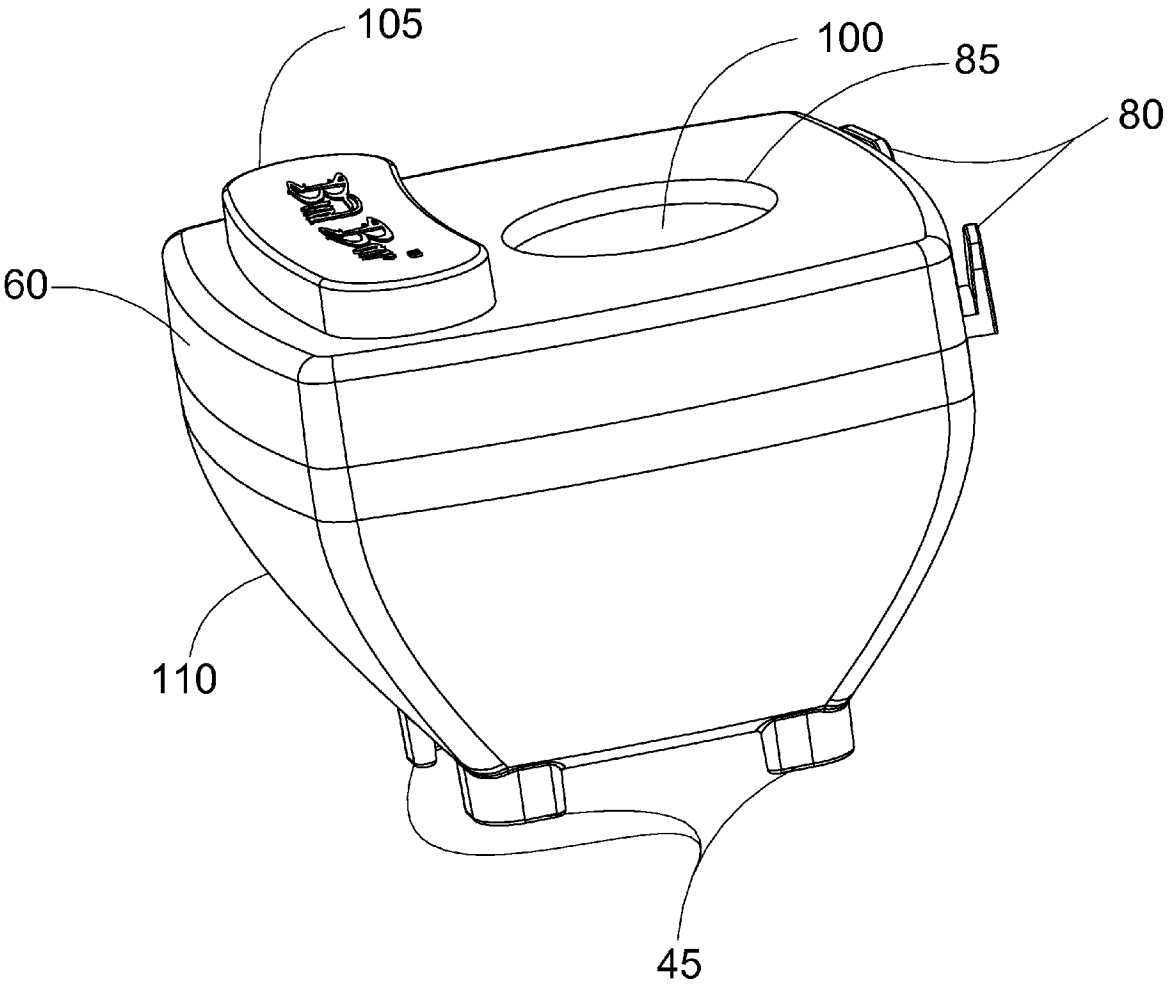
FIG. 8 is a perspective view of an embodiment of the present invention.
Figure 9:
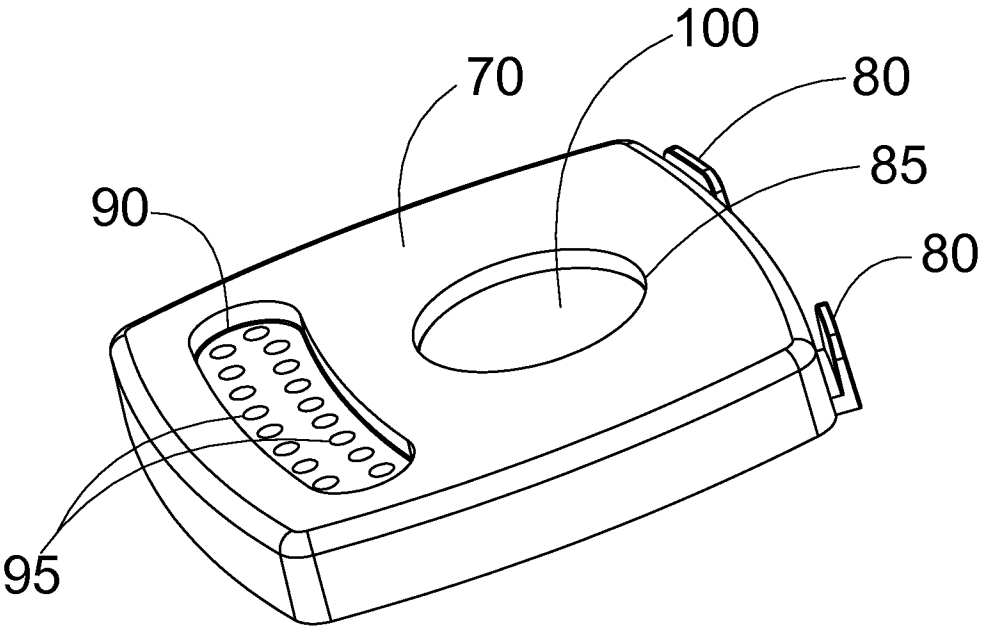
FIG. 9 is a perspective view of an embodiment lid of the present invention.

Turning to FIG. 8, Lid 60 is fitted on the perimetrical ridge 50 of said container body 10 forming an airtight chamber 110, wherein said plug 105 forms an airtight seal between plug 105 and recessed area 90 of said lid 60 completely sealing chamber 110. In one embodiment, plug 105 is comprised of soft material such as soft rubber or silicone.

Figure 2:
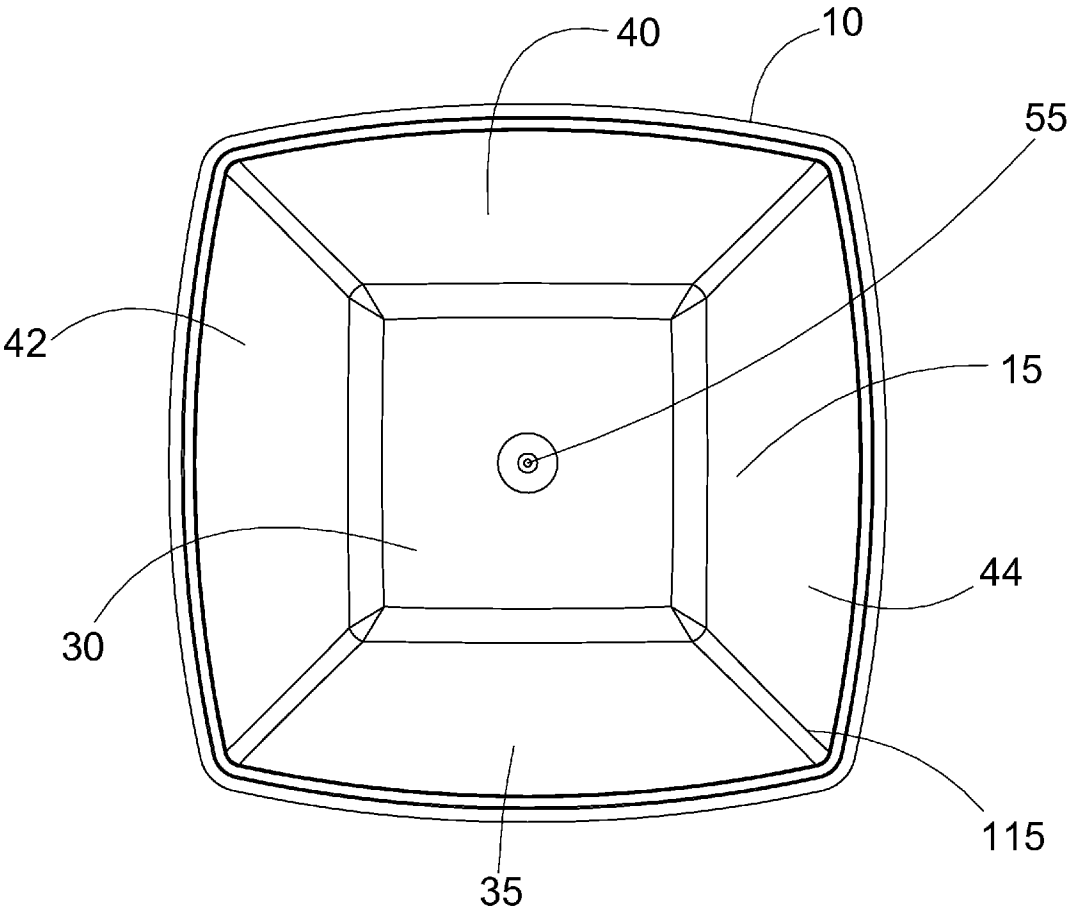
FIG. 2 is a top view of an embodiment container body of the present invention.

FIG. 2 illustrates a top view of container body 10 showing interior surface 15. It should be noted that in one embodiment, corners 115 between container body 10 front 35, a back 40, a first side 42, a second side 44, are rounded, yet in an alternative embodiment corners may be relatively sharp.

Figure 3:
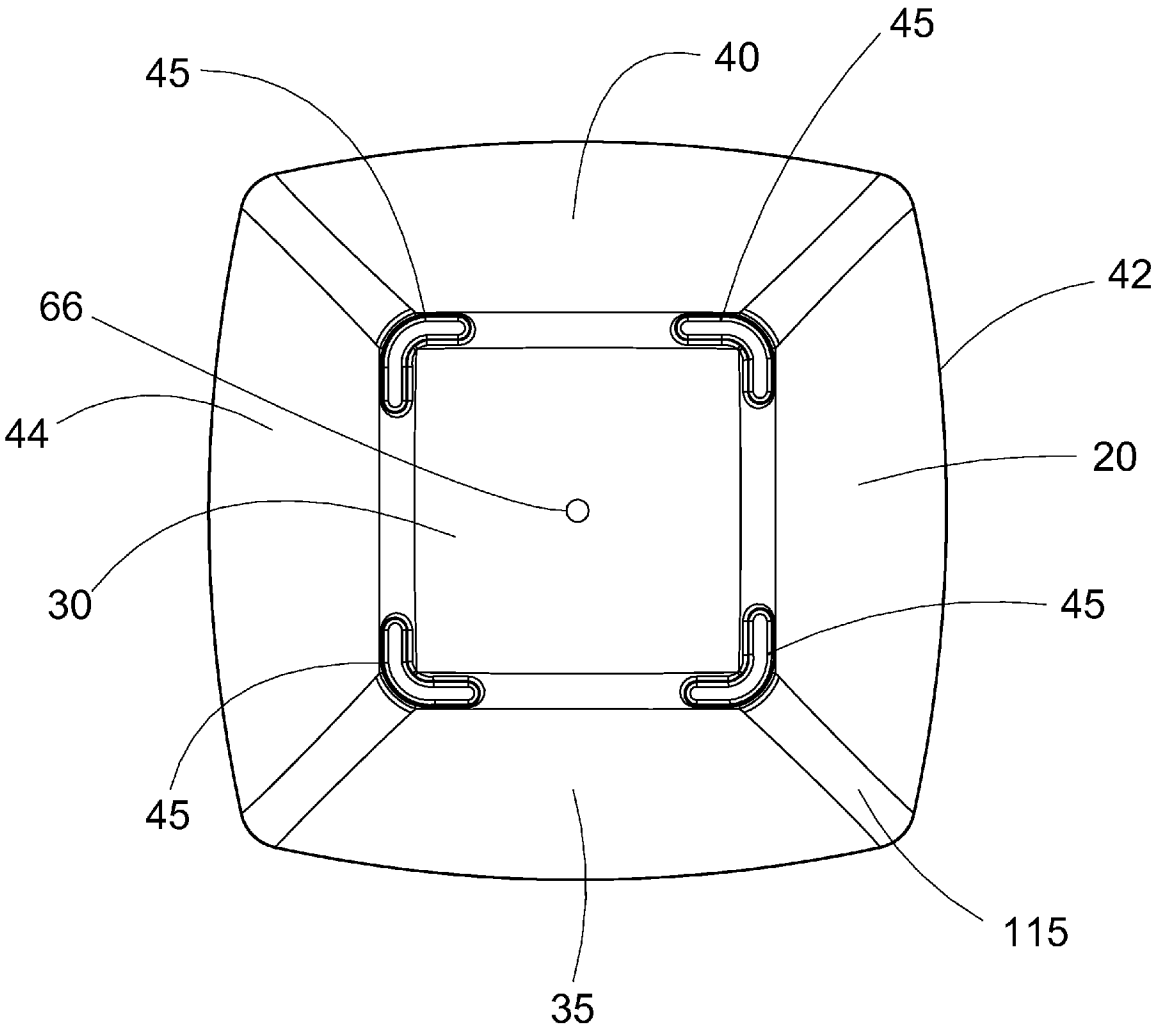
FIG. 3 is a bottom view of an embodiment container body of the present invention.
Figure 10:
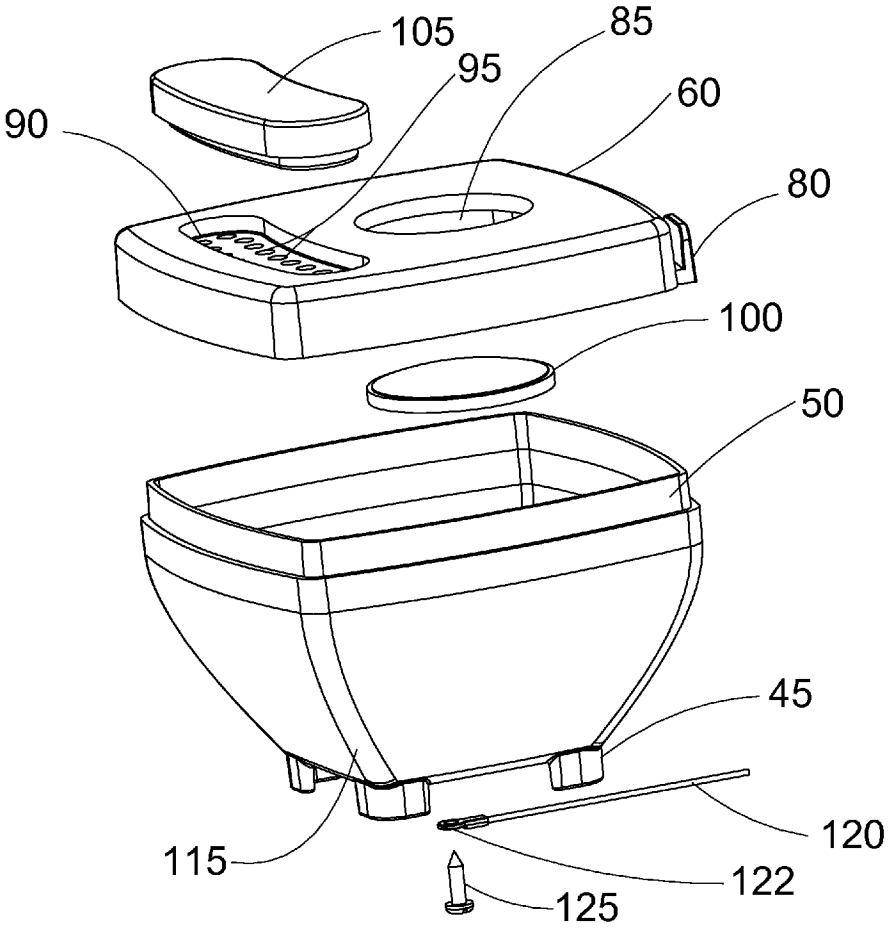
FIG. 10 is an exploded view of an embodiment of the present invention.
Figure 11:
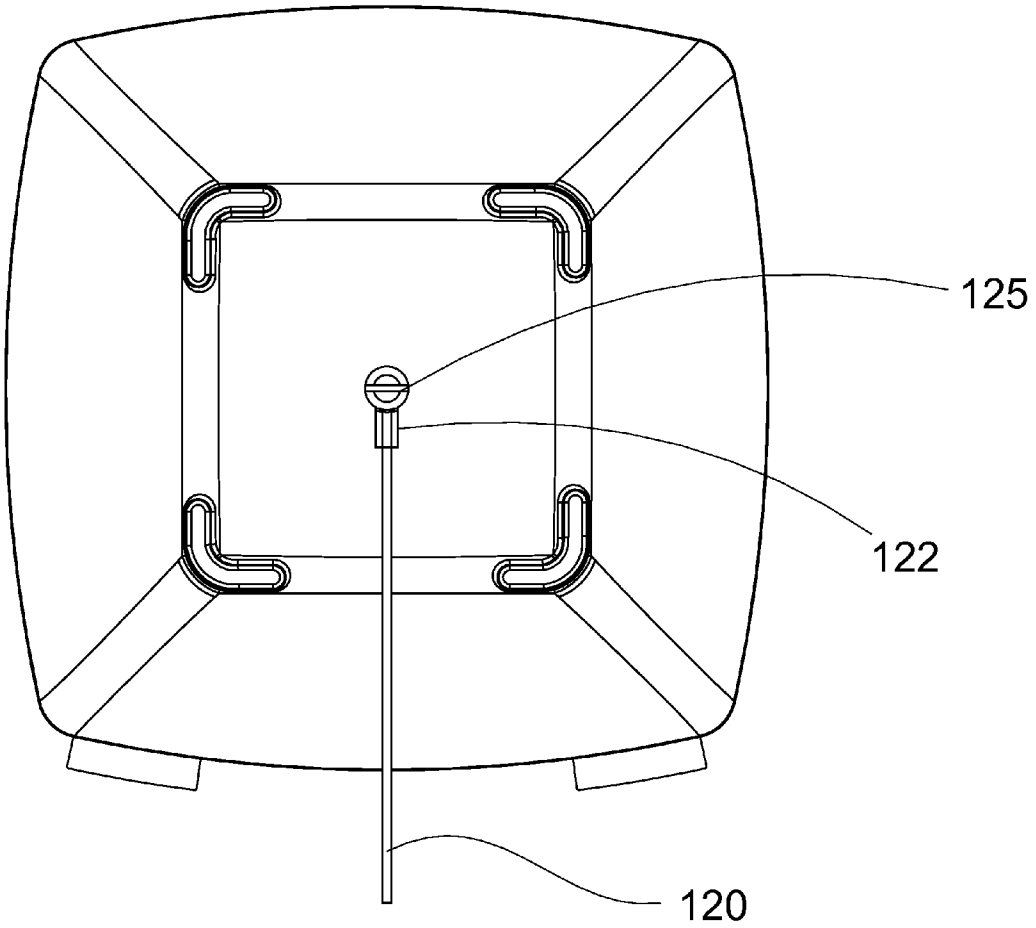
FIG. 11 is a bottom view of an embodiment container body and embodiment tether.

FIG. 3 illustrates a bottom view of container body 10 showing exterior surface 20. In one embodiment, bottom 30 is flat, in another embodiment, container body 10 bottom may be convex or concave. In a preferred embodiment, bottom 30 is flat and feet 45 allow container body 10 to be set on a flat resting surface where bottom 30 is not in contact with the flat surface. Mounting recess 66 allows an optional tether 120 to be affixed to the apparatus (FIGS. 10-11). In one embodiment, illustrated by FIGS. 10-11, tether 120 terminates in eyelet 122. Eyelet 122 is affixed to container 5 by screw 125 which passes through eyelet 122 and tapped into recess 66 thereby holding eyelet 122 and tether 120 in place. Tether 120 allows apparatus 5 to be carried by tether. Apparatus 5 may be rested on a flat surface with tether 120 in place because feet 45 provide sufficient clearance between the eyelet and the flat resting surface.

Figure 4:
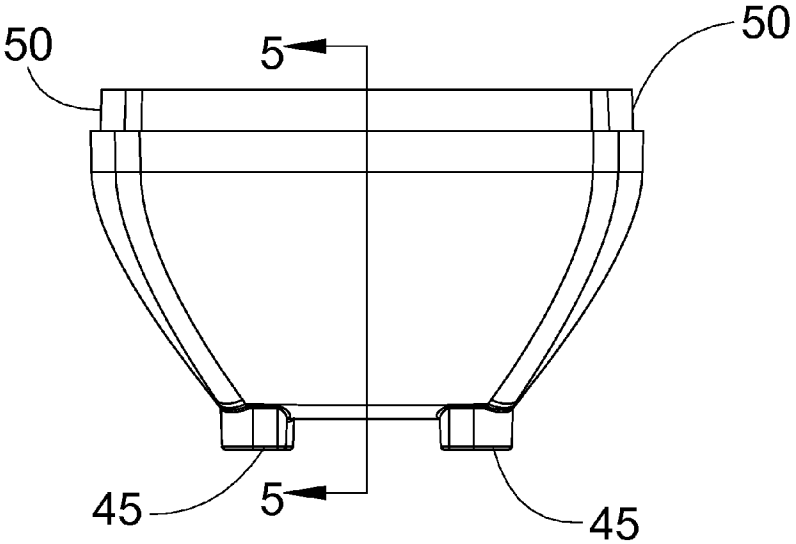
FIG. 4 is a side elevation view of an embodiment container body of the present invention.

FIG. 4 illustrates a side elevation view illustrating feet 45 and perimetrical ridge 50.

Figure 5:
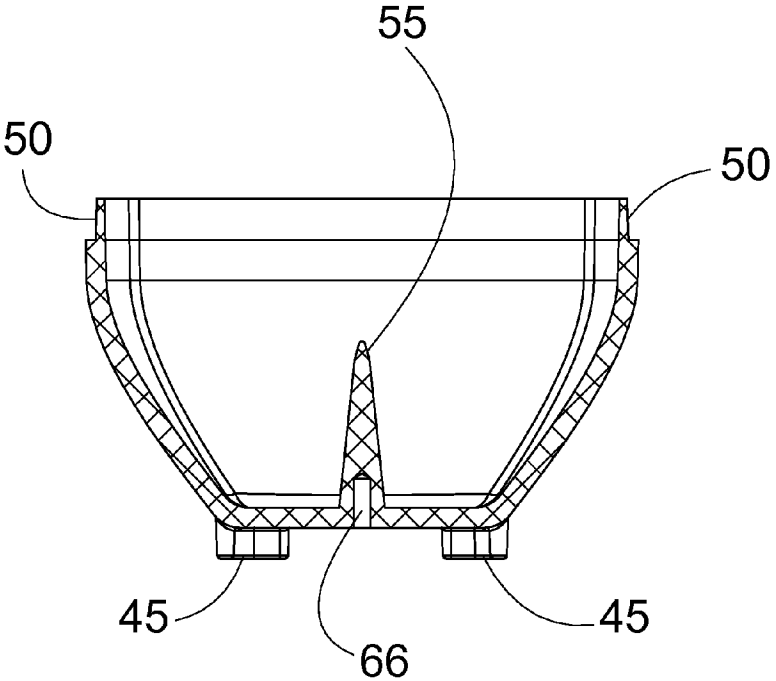
FIG. 5 is a cross-sectional view taken through line 5-5 of FIG. 4.
Figure 6:
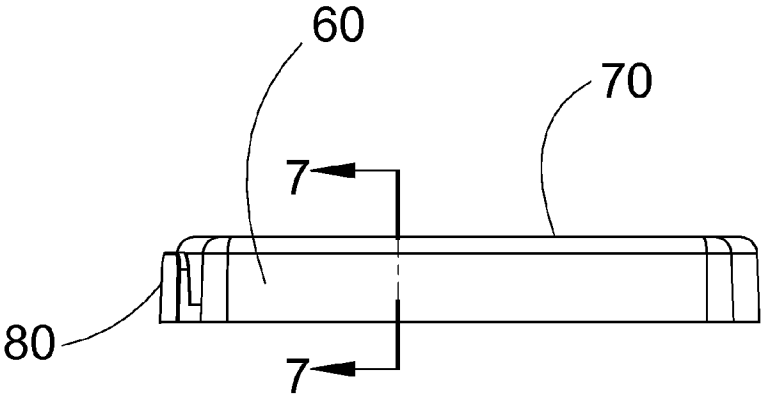
FIG. 6 is a side elevation view of an embodiment lid of the present invention.

FIG. 5 is a sectional view taken through line 5-5 of FIG. 4, illustrating a section of mounting spike 55 and recess 66 within. FIG. 6 is a side elevation view of lid 60 demonstrating exterior lid surface 70 and projection 80. FIG. 7 is a sectional view taken through line 7-7 of FIG. 6. Lens 100 is shown within viewing opening 85. In one preferred embodiment, lens 100 is countersunk within viewing opening 85. In an alternative, lens 100 may be domed above viewing opening 85. Lens 100 may be mounted on or within viewing opening 85 in any fashion permitting visualization through viewing opening 85. In one embodiment, lens 100 may be replaced with a window which provides viewing but lacks magnification power.

In use, a botanical sample, such as a sample of *cannabis*, is selected and placed within container body 10. A portion of the sample may be mounted on mounting projection 55. In one example, the end of mounting projection 55 is relatively sharp and capable of piercing a botanical sample—such as a botanical sample of *cannabis*. The sample is held on projection 55 due to frictional contact with the sample and aided by the sticky nature of the resin. Lid 60 engages perimetrical ridge 50 container body 10 fastening lid 60 and container body 10 together to form chamber 110. Plug 105 is inserted within recessed area 90 to seal the plurality of scent openings 95 to make chamber 110 airtight. An identification card, bearing information about the botanical product, may be secured by two projections 80. An optional, tether 120 may be affixed as described above. In one embodiment, such a tether may be a lanyard worn about the neck. In another embodiment, tether 125 may be retractable. Tether 125 may be affixed by other means—screw 125 and eyelet 122 providing only an example.

Container body 10 and lid 60 may be formed by injection molding and comprised of Poly(methyl methacrylate) (PMMA). Alternatively, container body 10 and lid 60 may be comprised of Styrene Acrylonitrile resin (SAN) or polycarbonate plastic. Container body 10 and lid 60 may be comprised of any moldable material. Container body 10 and lid 60 may be transparent, translucent or opaque—depending on the specimen to be contained within.

Container 5 may be used for a variety of purposes. For example the inventive apparatus may be used as an entomological storage display. In an alternative, mounting projection 55 may be outfitted with one or more pins, clips, fasteners, prong holder, or adhesive contacts to prepare and display specimens. Further, the present invention is of use for storage, presentation and display of many other items where magnification of the sample or product is desired. For example, projection 55 may be modified to hold other collectable collectible items such as coins, stamps, or jewelry. It these embodiments, lid 60 will be optional shaped without a recessed area or scent holes, or shaped to provide an opening for ventilation. In one embodiment, lid 60 provides user-adjustable ventilation.

Although the present invention has been described with reference to the preferred embodiments, it should be understood that various modifications and variations can be easily made by those skilled in the art without departing from the scope and spirit of the invention. Accordingly, the foregoing disclosure should be interpreted as illustrative only and is not to be interpreted in a limiting sense. It is further intended that any other embodiments of the present invention that result from any changes in application or method of use or operation, which are not specified within the detailed written description or illustrations contained herein yet, are considered apparent or obvious to one skilled in the art are within the scope of the present invention. Further, it should be noted that several inventive embodiments and features are disclosed together for convenience; unless specified otherwise, all embodiment inventive options disclosed herein may be used independently from each other or cooperatively together. Use of distinct reference characters is for illustrative purposes only, and the illustrated embodiment or feature may be used either cooperatively with or distinctly from any other embodiment or feature unless specified otherwise.

We claim:

1. A container comprising: a container body having an interior surface and exterior surface, said container body is shaped to define an open top, a bottom, a front, a back, a first side, a second side, wherein said container body is shaped to define a plurality of feet, wherein said container body is shaped to define a perimetrical ridge surrounding said open top, wherein said container body is further shaped to define a mounting projection disposed on the interior of said bottom of the container body, wherein said mounting projection is relatively sharp and capable of piercing a botanical sample, wherein said botanical sample is held on said mounting projection due to frictional contact with the sample;

a lid having an interior surface and exterior surface, wherein said lid is shaped to define a perimeter, said lid is further shaped to define at least one projection disposed on a portion of said exterior surface of said lid, wherein said projection disposed on a portion of said exterior surface functions as a card holder, wherein said lid is shaped to define a viewing opening, wherein said lid is further shaped to define a recessed area, wherein said lid is shaped to define a plurality of scent openings within said recessed area;

a countersunk plano-convex lens adhesively affixed to lid to cover said viewing opening on said lid, wherein said lens forms an airtight seal between said lens and said lid;

a removable soft plug shaped to fit within said recessed area forming an airtight seal;

wherein said lid is fitted on the perimetrical ridge of said container body forming a chamber, wherein said plug forms an airtight seal between said plug and said lid completely sealing said chamber.

2. The container of claim 1, further comprising a tether affixed to container body.

3. The container of claim 1, wherein said lid and said container body are comprised of Poly(methyl methacrylate).

4. The container of claim 1, wherein said lid and said container body are comprised of Styrene Acrylonitrile resin (SAN).

5. The container of claim 1, wherein said container body is shaped to define a mounting recess.

* * * * *